US005909775A

United States Patent [19]

Grindley

[11] Patent Number: 5,909,775

[45] Date of Patent: Jun. 8, 1999

[54] DUAL CHAMBER FOAM PUMP

[76] Inventor: Robert M. Grindley, 1989-A Blake Ave., Los Angeles, Calif. 90039

[21] Appl. No.: 08/926,653

[22] Filed: Sep. 10, 1997

[51] Int. Cl.[6] ..... A62C 35/00

[52] U.S. Cl. ..... 169/14; 239/61; 239/310; 239/318; 417/404

[58] Field of Search ..... 169/14–16, 44; 239/61, 310, 318; 417/403, 404; 137/98

[56] References Cited

U.S. PATENT DOCUMENTS 4,722,358 2/1988 Christensen ..... 137/101.11

*Primary Examiner*—Andres Kashnikow
*Assistant Examiner*—Jorge Bocanegra
*Attorney, Agent, or Firm*—Wagner,Middlebrook & Kimbell

[57] ABSTRACT

A fire fighting foam proportioner for use in providing precise proportioning of foaming agent to fire fighting liquid, e.g., water, includes a conduit incorporating a check valve and a venturi with a dual chamber piston pump having one part connected to the high pressure water source at the inlet to the conduit and the other part connected to a source of the foaming agent and arranged to pump the foaming agent through a foam conduit to the throat of the venturi where it is mixed with the water. Reversible valves responsive to pump movement are connected to the first pump part to cause it to reverse direction at the end of each stroke. A pair of one-way check valves at each of the inlet and outlet ports of the second pump part keep the foaming agent moving through the foam conduit where it is controlled by a pressure equalizing valve and a metering valve. The area of the foam conduit is controlled by the equalizing valve which includes a spool valve having pressure sensing areas at each end. One end senses inlet water pressure and the other end senses foaming agent pressure at the outlet of the second pump part. The metering valve is adjustable to vary the percentage of foam to water.

10 Claims, 3 Drawing Sheets

FIG. 1
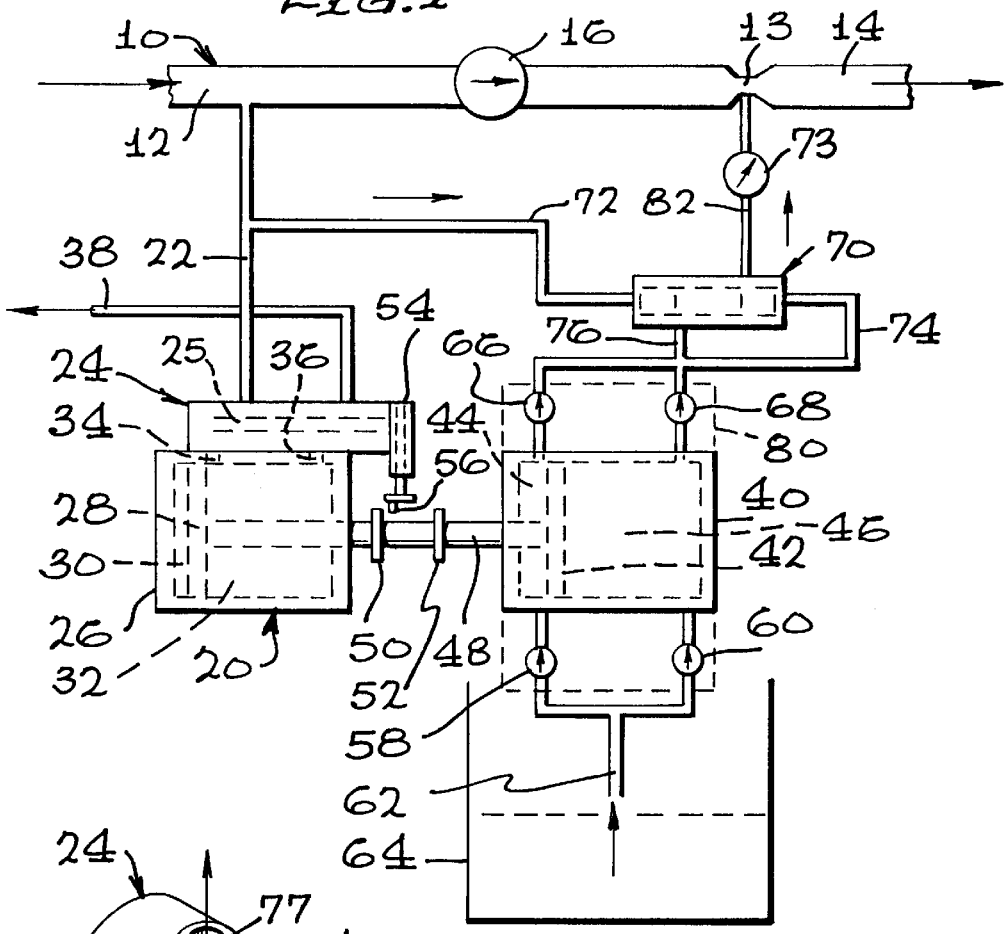
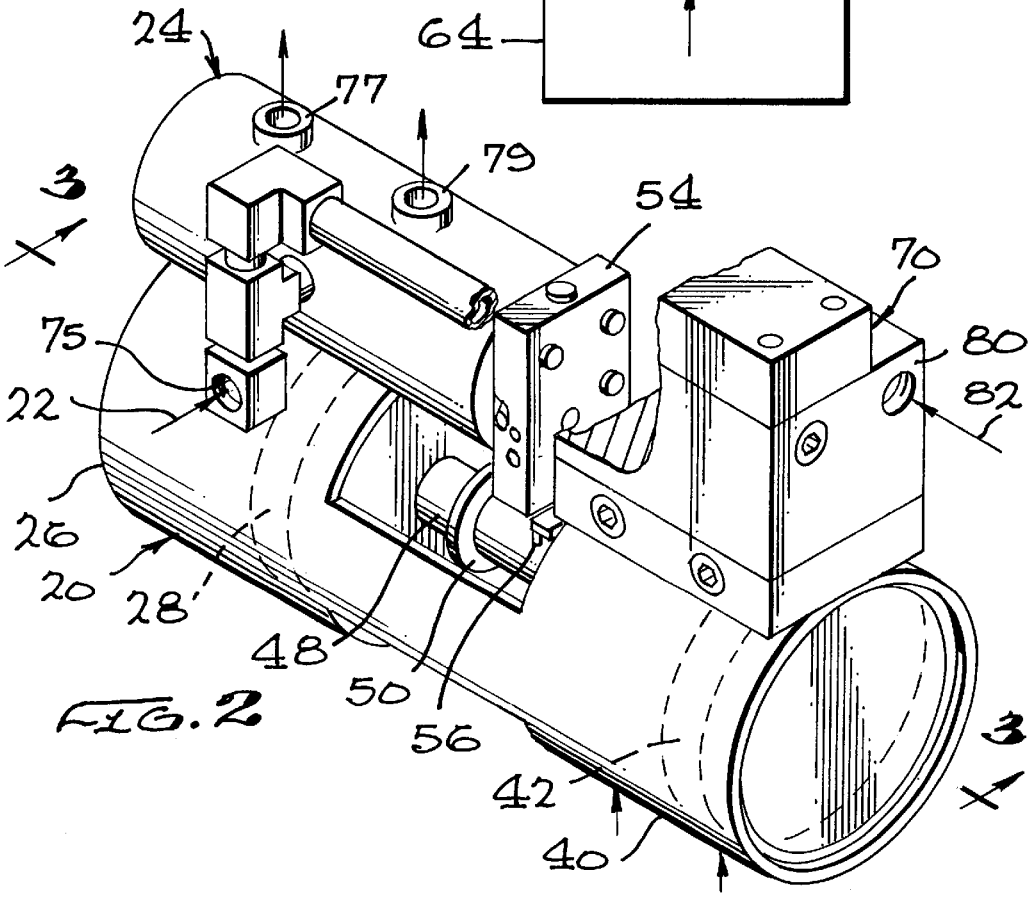
FIG. 2

DUAL CHAMBER FOAM PUMP

BRIEF SUMMARY OF THE INVENTION

It has long been recognized that adding foaming agents to fire fighting water has substantially increased the fire fighting efficiency of water. Over time, the foaming agent to water ratio has gradually decreased from 6:94 to as low as 0.2:99.8. It has been determined in recent years that controlling the ratio in 0.2% increments from 0.2:99.8 to 1:99 provides a satisfactory range. This ratio should be held despite fluctuations in pressure to the water line.

The reduction in the ratio of foaming agent to water has put a premium on accuracy in the proportioning which was dealt with in U.S. Pat. No. 5,009,244 (common assignee). In this patent a system is described in which the foaming agent is placed in a bladder, a flexible, compressible bag, secured within a container such as a five gallon tank where it is surrounded by water at the delivered pressure. While this system operates well and holds the desired proportions despite changes in line pressure, it has been found inconvenient and undesirable to be required to add more foaming agent to the bladder at frequent intervals while fighting a fire. What is needed is a system for adding foaming agent to water at the desired proportions and which can provide a continuous supply of foaming agent from a large reservoir.

Applicant has designed a system in which a dual chamber piston type pump is connected to water from a high pressure line connected to a source such as that supplying a fire hose and which may be approximately 300 psi. A check valve and a venturi in the line define a pressure drop which effectively operates the pump. A spool-type operating valve is controlled by a pilot valve to direct water at inlet pressure alternately to opposite sides of a piston in the pump. A second pump portion which includes a second piston directly driven by the pump piston is connected to a source of foaming agent, which may be in a typical 55 gallon drum, and which is at atmospheric pressure. As the pump portion is driven, its piston reciprocates in its chamber thereby pulling foaming agent from the source and pumping it toward the venturi. A check valve manifold includes one way check valve which permit foaming agent to be drawn alternately, into chambers on opposite sides of the second piston while driving the foam out toward a pressure equalizing valve. The equalizing valve includes a spool having one end connected to water inlet pressure and its opposite end connected to foaming agent pressure downstream of the check valve manifold. It thereby controls an effective area of the foaming agent line. This flow is further modified by a metering valve which provides the above described fine adjustment of the foaming agent to water before the foaming agent is supplied to the venturi where it is mixed with the fire fighting water.

BRIEF DESCRIPTION OF THE DRAWING(S)

This invention may be more clearly understood with the following detailed description and by reference to the drawings in which:

FIG. 1 is a schematic drawing of a foaming agent/water mixing system according to the invention:

FIG. 2 is a perspective view of the system of FIG. 1;

DETAILED DESCRIPTION OF THE INVENTION

Figure 3:
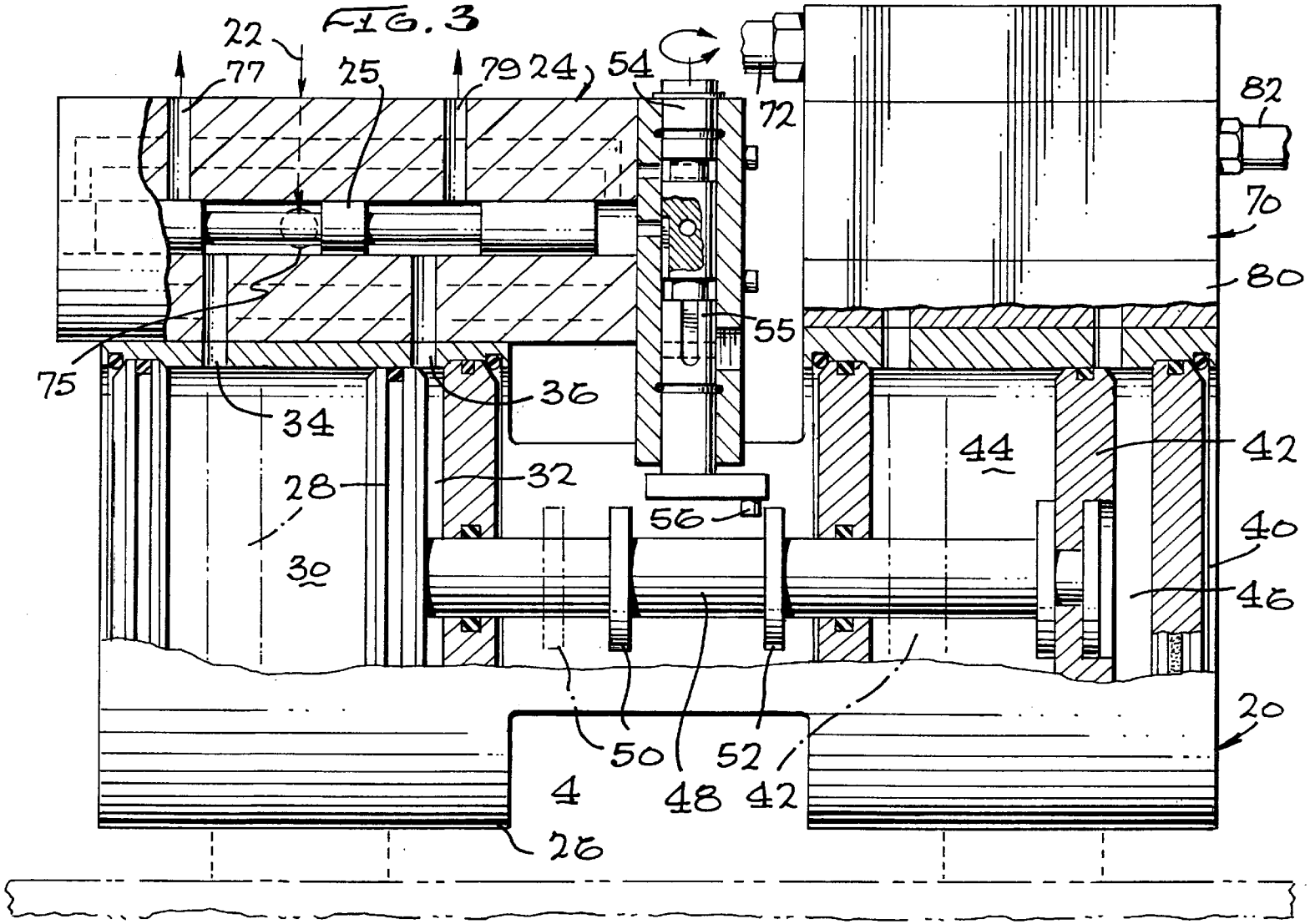
FIG. 3 is a sectional view taken along line 3—3 of FIG. 2.

Referring now to FIG. 1, a water conduit 10 is shown having an inlet 12 to which water is supplied at a substantial pressure such as 300 psi and an outlet 14 which is normally connected to a hose (not shown). Positioned in conduit 10 are a spring loaded check valve 16 and a venturi 13. As will be understood by those skilled in the art, a substantial pressure drop exists between inlet 12 and outlet 14.

A pump 20 is connected to inlet 12 through a conduit 22 and an operating valve 24. Pump 20 includes a first cylinder 26 with a piston 28 in the cylinder dividing cylinder 26 into two chambers 30 and 32. Ports 34 and 36 in the wall of cylinder 26 communicate with chambers 30 and 32, respectively. Operating valve 24 contains a spool, described below having a plurality of lands and also end surfaces to which water pressure is applied to align the spool with ports 34 and 36 such that water at inlet pressure is supplied to one of chambers 30 or 32 while permitting water to flow out of the other of said chambers across valve 24 to a conduit 38 connected to a low pressure source.

A second cylinder 40 contains a second piston 42 dividing cylinder 40 into two chambers 44 and 46. Pistons 28 and 42 are connected together by means of a shaft 48 which passes through facing ends of cylinders 26 and 40. Secured on shaft 48 between these ends are a pair of collars 50 and 52.

Secured to operating valve 24 is a pilot valve 54 which includes an internal spool connected to a feeler member 56 positioned between collars 50 and 52. As piston 28 approaches the end of its travel in a first direction, one of collars 50 or 52 will contact feeler member 56, causing it to move the internal spool in pilot valve 54 to a different position resulting in disconnecting one end of the spool in operating valve 24 from inlet pressure and connecting it to low pressure. At the same time, the opposite end of the spool is connected to inlet pressure and disconnected from low pressure. This causes the spool valve to move to a new position where it reverses the pressure across piston 28 causing it to move in the opposite direction. As piston 28 moves toward the end of its travel in the opposite direction, the other of collars 50 or 52 will again contact feeler member 56 again causing the pilot valve 54 to reverse the water pressure across the spool valve and causing it to again reverse the pressure across piston 28. Thus piston 28 reciprocates in cylinder 26 and, through its connection with piston 42, causes piston 42 to reciprocate in cylinder 40 as well.

Cylinder 40 is connected through a pair of one-way check valves 58 and 60 with a conduit 62 positioned to carry foaming agent from a reservoir 64. Also connected to cylinder 40 are a pair of additional one-way check valves 66 and 68 which are, in turn, connected to a pressure equalizing valve 70. Valve 70 is a spool valve having a sensing face at one end connected to a conduit 72 which effectively supplies inlet water pressure and another sensing face at the opposite end connected through a pipe 74 to a junction 76 to which foaming agent is supplied.

Pressure equalizing valve 70 thus includes a spool which seeks a position based on the sensed pressures across it and controls the effective area in the foaming agent line.

Downstream of pressure equalizing valve 70 is a metering valve 73 which may be manually set to vary the metering area in the line to provide the variation in foaming agent ratio to water discussed above, which may be from 0.2% to 1.0%.

FIG. 2 is a perspective view of the system of FIG. 1. The dual cylinders 26 and 40 are shown with pistons 28 and 42 appearing in phantom. Physically located on top of cylinder 26 is operating valve 24 with pilot valve 54 attached to the end of valve 24. Also shown through an open area between the cylinders 28 and 42 is a portion of shaft 48, with a collar 50 and feeler 56. The high pressure water line 22 is connected to a fitting 75 from whence high pressure water is supplied to operating valve 24 and also to pilot valve 54. Ports 77 and 79 are connected to conduit 38 connected to low pressure.

Foaming agent is supplied from the reservoir 64 to a manifold 80 which contains all of the one-way check valves 58, 60, 66, and 68. The equalizing valve 70 is secured to manifold 80.

FIG. 3 is a sectional view taken along line 3—3 of FIG. 2 and shows pistons 28 and 42 connected by shaft 48 and movable in cylinders 26 and 40 respectively. Operating valve 24 is shown containing a spool 25 which is movable laterally to direct a flow of high pressure water from line 22 and fitting 75 to one side or the other of piston 28 in cylinder 26. Operation of valve 24 is described in greater detail below. Attached to valve 24 is the pilot valve 54 which contains a rotatable member 55 movable by collars 50 and 52 as shaft 48 is moved. As shaft 48 moves toward its left or right hand limit of movement feeler 56 is moved to rotate member 55 in a direction to direct high pressure water against the one or the other end of spool 25 causing spool 25 to open communication between water inlet conduit 22 and one or the other side of piston 28, causing piston 28 to reverse direction.

As piston 28 moves, it carries piston 42 which pumps foaming agent from reservoir 64 as described. The manifold 80 carries one-way check valves 58, 60, 66 and 68 as described, and it receives foaming agent from reservoir 64 and directs it to the junction 76, from where it is supplied to the equalizing valve 70. Foaming agent then flows from equalizing valve 70 via a pipe 82 to metering valve 73.

Figure 4:
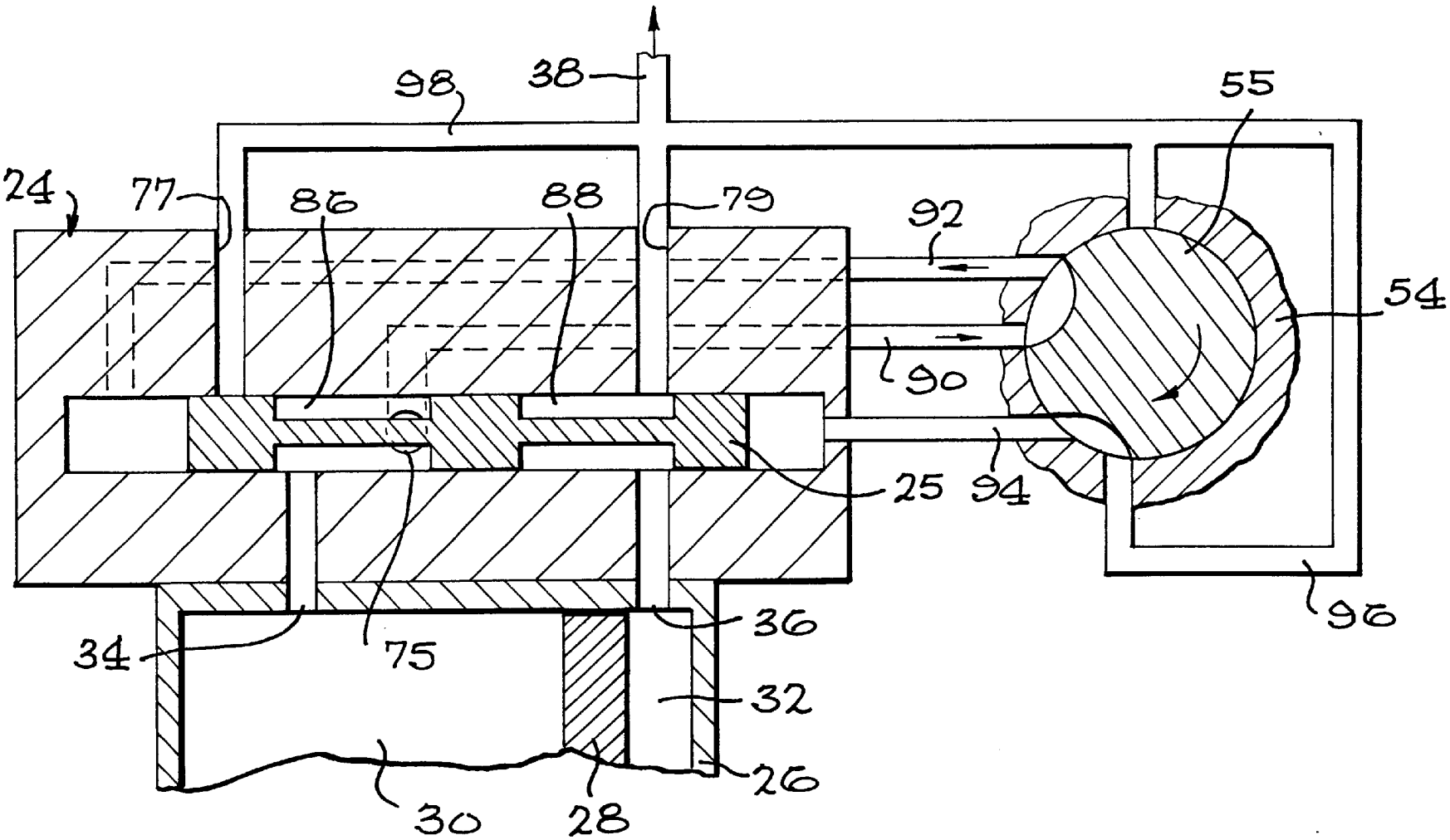
FIG. 4 is a schematic view showing the operation of the operating valve and pilot valve of FIG. 3.

FIG. 4 is a schematic diagram showing operation of operating valve 24, pilot valve 54, 55 and piston 28 in cylinder 26. As shown, water under high pressure is supplied from conduit 22 (FIG. 1) to fitting 75 leading to a chamber 86 between lands of spool 25 from where it passes through port 34 to the chamber 30 on the left side of piston 28. At this time chamber 32 on the right side of piston 28 is connected to low pressure conduit 38 through port 36 and a chamber 88 between lands of spool 25, thus causing piston 28 to move to the right. Also the high pressure in conduit 22 is connected to a line 90 leading to pilot valve 54 where it is connected through rotatable member 55 to a line 92 communicating with the left end of spool 25. The right end of spool 25 is connected through line 94 through rotatable member 55 and line 96 to low pressure conduit 38.

As piston 28 reaches a point near the end of its travel to the right, feeler 56 will rotate member 55 in pilot valve 54 in the direction of the arrow. This will place line 90 in communication with line 94 and line 92 in communication with line 96 and conduit 38, thus reversing the pressure on the ends of spool 25 and causing it to move to the left. This places high pressure from conduit 22, 77 across chamber 88, through port 36 and into chamber 32. At the same time pressure in chamber 30 on the left side of piston 28 is exhausted through port 34, chamber 86 and line 98 to exhaust conduit 38, moving piston 28 to the left. As piston 28 approaches the end of its travel to the left, the feeler 56 will again be reversed and cause member 55 in spool 25 to be reversed, again initiating movement of piston 28 toward the right. Thus pump 20 continually moves back and forth, carrying piston 42 and pumping foaming agent toward the venturi 13.

The above described embodiments of the present invention are merely descriptive of its principles and are not to be considered limiting. The scope of the present invention instead shall be determined from the scope of the following claims including their equivalents.

I claim:

1. A fire fighting system for proportioning the injection of foaming agent into a stream of water comprising a water conduit having an inlet and an outlet;

a venturi and valve means in said water conduit for maintaining a pressure differential between said inlet and said outlet;

a foaming agent reservoir;

conduit means connected between said reservoir and said venturi and pump means in said conduit means for supplying foaming agent to said venturi;

means connected to said inlet for driving said pump means;

a pressure equalizing valve in said conduit means responsive to water pressure at said inlet and to foaming agent pressure from said pump means for controlling the area of said conduit means; and a metering valve in said conduit means between said equalizing valve and said venturi.

2. A system as claimed in claim 1 wherein said conduit means includes one way check valve means for permitting flow from said reservoir to said pump means and from said pump means to said equalizing valve.

3. A fire fighting system for proportioning the injection of foaming agent into a stream of water comprising a water conduit having an inlet and an outlet;

a venturi and valve means in said water conduit for maintaining a pressure differential between said inlet and said outlet;

a foaming agent reservoir;

conduit means connected to said reservoir and pump means in said conduit means for supplying foaming agent to said venturi;

a pump connected to said inlet and to said pump means for driving said pump means;

an operating valve connected to said inlet for supplying water under pressure to said pump;

an equalizing valve in said conduit means having a first pressure sensing area exposed to the pressure of the foaming agent from said pump means and a second pressure sensing area exposed to the water pressure at said inlet; and a metering valve in said conduit means for establishing a desired proportion of foaming agent to water in said water conduit.

4. A system as claimed in claim 3 further comprising means responsive to movement of said pump for reversing the direction of said pump.

5. A fire fighting system as claimed in claim 4 wherein said pump means includes a cylinder, a piston reciprocatable in the cylinder dividing said cylinder into two chambers, and a plurality of check valves are connected to each chamber such that said pump means pumps foam concentrate toward said venturi with piston movement in either direction.

6. A system as claimed in claim 4 wherein said operating valve is a reversible spool valve connected to said inlet, said pump and said pump means comprise respectively a first cylinder connected to said operating valve and a first piston in said cylinder, a second cylinder and a second piston in said second cylinder, and a shaft connecting said first and second pistons together.

7. A system as claimed in claim 6 wherein said means for reversing the direction of said pump includes a pilot valve responsive to movement of said shaft for reversing the water pressure across said spool valve to direct water at inlet pressure from one side to the other of said first piston.

8. A system as claimed in claim 3 wherein said valve means in said water conduit is a spring loaded check valve.

9. A system as claimed in claim 6 wherein said conduit means includes a plurality of one way check valves for permitting flow from said reservoir to said second cylinder and a plurality of one way check valves for permitting flow from said second cylinder to said equalizing valve.

10. In a fire fighting system for proportioning the injection of a foaming agent into a fluid stream having a primary fluid delivery conduit having an inlet and an outlet, a venturi and valve means in said conduit for maintaining the fluid pressure at said inlet above the fluid pressure at said outlet;

a foaming agent reservoir;

a pump and conduit means for connecting said pump to said reservoir and to said venturi, said pump including a first cylinder and a first piston in said first cylinder, a second cylinder and a second piston in said second cylinder, a shaft connecting said pistons, and a pair of spaced collars on said shaft;

an operating valve connected to control water flow to opposite sides of said first piston and a first conduit connecting said operating valve to said inlet, a second conduit connecting said operating valve to a low pressure source;

a pilot valve connected to said operating valve including a sensor responsive to contact with said collars for reversing fluid pressure across said operating valve to reverse water flow from one side to the other of said first piston;

a plurality of check valves in said conduit means for controlling the flow of foaming agent into and out of said second cylinder;

a pressure equalizing valve in said conduit means connected to sense the pressure of foaming agent out of said second cylinder and the water pressure in said first conduit to establish the area of said conduit means; and a metering valve in said conduit means for controlling the proportion of foaming agent to water in said fluid stream.

* * * * *